US011257316B2

(12) United States Patent
Rohrl et al.

(10) Patent No.: US 11,257,316 B2
(45) Date of Patent: Feb. 22, 2022

(54) DEVICE AND METHOD FOR EVALUATING SENSOR DATA FOR A VALUE DOCUMENT

(71) Applicant: GIESECKE+DEVRIENT CURRENCY TECHNOLOGY GMBH, Munich (DE)

(72) Inventors: Wolfgang Rohrl, Riemerling (DE); Karl-Dieter Forster, Deisenhofen (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 540 days.

(21) Appl. No.: 16/086,075

(22) PCT Filed: Mar. 16, 2017

(86) PCT No.: PCT/EP2017/000343
§ 371 (c)(1),
(2) Date: Sep. 18, 2018

(87) PCT Pub. No.: WO2017/157524
PCT Pub. Date: Sep. 21, 2017

(65) Prior Publication Data

US 2020/0294343 A1 Sep. 17, 2020

(30) Foreign Application Priority Data

Mar. 18, 2016 (DE) ..... 10 2016 003 362.2

(51) Int. Cl.
*G07D 11/34* (2019.01)
*G07D 11/50* (2019.01)
(Continued)

(52) U.S. Cl.
CPC ..... *G07D 11/34* (2019.01); *G07D 7/08* (2013.01); *G07D 7/121* (2013.01); *G07D 11/50* (2019.01);
(Continued)

(58) Field of Classification Search
CPC ..... G07D 11/34; G07D 11/50; G07D 7/08; G07D 7/121; G07D 2207/00; G07D 2211/00; G07D 11/40
See application file for complete search history.

(56) References Cited

U.S. PATENT DOCUMENTS 7,900,248 B2 * 3/2011 Ellison ..... G06F 21/6218 726/10
7,954,700 B2 6/2011 Stapfer
(Continued)

FOREIGN PATENT DOCUMENTS

DE 102006028632 A1 12/2007
EP 2919204 A1 9/2015
(Continued)

OTHER PUBLICATIONS

International Search Report from PCT Application No. PCT/EP2017/000343, dated Jun. 27, 2017.
(Continued)

*Primary Examiner* — Sonji N Johnson
(74) *Attorney, Agent, or Firm* — Workman Nydegger

(57) ABSTRACT

A method for evaluating sensor data for a value document includes a memory and a multi-core processor arranged to access the memory. A management sub-group of the cores comprises at least one of the cores, and at least one evaluation subgroup of the cores comprises at least one other of the cores. The management subgroup manages the memory regarding the storing of at least the sensor data and generates evaluation information for carrying out the evaluation. At least one evaluation subgroup carries out at least one part of the evaluation in dependence on the evaluation information and stores the result in the memory.

30 Claims, 5 Drawing Sheets

(51) Int. Cl.
*G07D 7/08* (2006.01)
*G07D 7/121* (2016.01)

(52) U.S. Cl.
CPC ..... *G07D 2207/00* (2013.01); *G07D 2211/00* (2013.01)

(56) References Cited

U.S. PATENT DOCUMENTS

| | | | | |
|---|---|---|---|---|
| 8,403,206 | B2 | 3/2013 | Stapfer | |
| 8,989,092 | B2 * | 3/2015 | Xing | H04W 4/50 370/328 |
| 2009/0279771 | A1 | 11/2009 | Stapfer | |
| 2011/0203900 | A1 | 8/2011 | Stapfer | |
| 2015/0039873 | A1 * | 2/2015 | Lesartre | G06F 9/44505 713/1 |

FOREIGN PATENT DOCUMENTS

| | | | |
|---|---|---|---|
| WO | 02071246 | A2 | 9/2002 |
| WO | 2014118763 | A1 | 8/2014 |

OTHER PUBLICATIONS

German Search Report from DE Application No. DE102016003362.2, dated Dec. 5, 2016.
Martos, "Eleven Meters per Second: Checking Banknotes at Lightning Speed," DiePresse.com, Jun. 19, 2015, 5 Pages.

* cited by examiner

DEVICE AND METHOD FOR EVALUATING SENSOR DATA FOR A VALUE DOCUMENT

BACKGROUND

The present invention relates to a method for evaluating sensor data for a value document and means for carrying out the method, in particular a device for evaluating sensor data for a value document.

Value documents are understood here to be sheet-shaped objects that represent for example a monetary value or an authorization and hence should not be manufacturable arbitrarily by unauthorized persons. They hence have features that are not simple to manufacture, in particular to copy, whose presence is an indication of authenticity, i.e. manufacture by an authorized body. Important examples of such value documents are coupons, vouchers, checks and in particular bank notes.

Value documents are frequently machine-checked in value-document processing apparatuses as to authenticity and state, and are sorted in dependence on the result of the check. For this purpose they are transported in singled form past sensors which capture physical properties of the value document and form the results of the capture-representing sensor data. These sensor data are evaluated by means of an evaluation device of the value-document processing apparatus, i.e. the evaluation device establishes a sorting class while employing the sensor data, and in dependence on the result of the evaluation the value document is sorted, for example fed to one of at least two output portions.

Improvements in the sensors, in particular in their local resolution, lead to distinctly greater quantities of sensor data respectively captured for a value document. Further an increased processing speed is aimed at. Furthermore properties of the value documents should be established more precisely, which requires more elaborate methods for evaluating the sensor data. In addition, for the machine check this evaluation has to be carried out in real time. These factors result in strongly elevated demands as to the processing speed of the evaluation device.

SUMMARY

The present invention is hence based on the object of stating a method for evaluating sensor data for a value document which makes a fast evaluation of sensor data possible as well as providing a device for evaluating sensor data for a value document and means for carrying out the method which make a fast evaluation of sensor data possible.

The object is achieved by a device for evaluating sensor data and in particular a device for evaluating sensor data for a value document, having a memory for storing at least the sensor data for the value document, a multi-core processor having at least two cores, and software which comprises a management component and an evaluation component for carrying out evaluations of the sensor data, wherein the device is devised such that a management subgroup of the cores having at least one of the cores and at least one evaluation subgroup of the cores having at least one other of the cores are formed, that the management component for its execution is associated with the management subgroup, and that the evaluation component for its execution is associated with the at least one evaluation subgroup, wherein upon execution by the management subgroup, the management component manages the memory with regard to the storing of at least the sensor data and generates evaluation information for carrying out the evaluation, and wherein upon execution by at least one evaluation subgroup, the evaluation component carries out at least one part of the evaluation in dependence on the evaluation information and stores the result in the memory.

The object is further achieved by a method for evaluating sensor data for a value document and in particular a method for evaluating sensor data for a value document, in which a memory and a multi-core processor which can access the memory are employed, in which a management subgroup of the cores comprises at least one of the cores and at least one evaluation subgroup of the cores comprises at least one other of the cores, in which the management subgroup manages the memory with regard to the storing of at least the sensor data and generates evaluation information for carrying out the evaluation, and in which the at least one evaluation subgroup carries out at least one part of the evaluation in dependence on the evaluation information and stores the result in the memory. The method according to the invention is executable by a device according to the invention.

The evaluation device can be used in particular in an apparatus for processing value documents. The subject matter of the present invention is hence also an apparatus for processing value documents, having a feeding device for feeding singled value documents, an output device for outputting processed value documents, a transport device for transporting singled value documents from the feeding device to the output device, a sensor device for capturing physical properties of value documents transported by the transport device and forming sensor data for the respective value document, and an evaluation device according to the invention connected to the sensor device for evaluating the sensor data of the sensor device.

Preferably the apparatus can further have a machine control device connected to the evaluation device which drives the transport device in dependence on the result of the evaluation of the sensor data.

According to the invention a multi-core processor which has at least two cores is employed. Multi-core processors are microprocessors having at least two largely mutually independent CPU cores including separate register sets and arithmetic logical unit (ALU) which can, however, share a bus and, where applicable, caches.

Further a memory is provided which serves for storing at least the sensor data for the value document and can be, for example, ordinary volatile memory (RAM). The evaluation device is designed such that the multi-core processor can access the memory for reading and writing.

Further the device has software which can be stored in a memory device of the device and is executable by the multi-core processor.

Upon the execution of the evaluation at least two subgroups of the processor cores are distinguished. A management subgroup comprises at least one of the cores and an evaluation subgroup likewise comprises at least one of the cores. In doing so, each of the cores of the multi-core processor is associated with at most one of the subgroups. These groups are preferably not designed as physically separate, but are determined or formed by the software and/or corresponding configuration parameters which are employed upon the execution of the software, preferably only during operation of the evaluation device.

In the method, the management subgroup executes operations which the evaluation subgroup does not need to execute, so that the latter is relieved and the part of the evaluation executed by it can be executed faster. Thus the management subgroup manages the memory at least with regard to the sensor data and generates evaluation information for carrying out the evaluation. In dependence on the evaluation information, the evaluation subgroup carries out at least one part of the evaluation and stores the result in the memory. Preferably the evaluation subgroup carries out at least those parts of the evaluation which represent a high processing load.

The division into subgroups has the advantage that with it the components are fixedly associated with a certain number of cores and with it a certain quantity in computing power and none of the components can utilize cores excessively for own tasks at the expenses of the other component.

Preferably a communication, in particular a data exchange, is effected between the management subgroup or the management component and the evaluation subgroup or evaluation component, preferably except for operating-system operations, only by means of the memory, particularly preferably via the evaluation information deposited in the memory and the results of the evaluation deposited in the memory. Besides, an interaction between the components can, however, be effected by objects of the operating system or operating-system objects, for example, semaphore or similar.

In the method it is preferred that the cores of the management subgroup and the at least one evaluation subgroup are managed by a single operating-system entity. In the device or evaluation device it is then preferred that the cores of the management subgroup and those of the at least one evaluation subgroup are managed by one single operating-system entity and both have access to the memory. The cores of the subgroups are thus jointly managed by an entity of the operating system, i.e. in particular that the cores of the subgroups can utilize the same functions and services provided by the operating system. The software of the device can comprise code of an operating system, upon whose execution the cores of the management subgroup and the at least one evaluation subgroup are managed by the same operating-system entity. Where applicable, in dependence on the configuration data which are stored in the device, the subgroups can then preferably be formed by the operating system upon starting the device. This facilitates in particular the management of the memory and the cores. The management component and the evaluation component are both executed under the same operating system entity, i.e. for their execution the same operating-system entity is used. In doing so, the operating system controls the execution of processes, functions etc. for each of the subgroups independently of the execution of processes, functions etc. of the other subgroup or subgroups; preferably the software, in particular the operating system, is devised to employ upon execution of a respective component multitasking in the subgroup serving for its execution. Particularly preferably, a scheduler can be provided for each of the subgroups or a corresponding instance of the component executed by this, which operates independently of a scheduler of a respective other subgroup. The software is preferably designed such that in the case that a subgroup contains at least two cores, the employment of the cores of the subgroup for executing the component which is executed by means of this subgroup is controlled independently of the employment of the cores of other subgroups. However, particularly preferably a scheduler can also be provided which for their execution associates components with cores of the subgroup provided for executing the respective component, wherein the association of the cores of a subgroup is independent of that of the other subgroups.

In principle the number of the cores in the subgroups can be pre-specified arbitrarily. It is, however, preferred according to one embodiment of the method that the management subgroup comprises exactly one core. In the device it can be preferred for this purpose that the management subgroup comprises exactly one core. In particular for this purpose corresponding configuration data can be stored in the device. More cores of a multi-core processor can thereby be made available for the at least one evaluation subgroup, so that more resources are available for carrying out the evaluation. This is in particular then an advantage when the demands for the computing power required for the actual evaluation are high, the management, however, requires only few resources.

Accordingly it is preferred in the method that the at least one evaluation subgroup comprises at least two cores. In the device it is preferred for this purpose that at least one evaluation subgroup comprises at least two cores. In particular for this purpose corresponding configuration data can be stored in the device. A high computing power for evaluation purposes is provided by such a configuration.

The management subgroup executes different functions for which in the device the management component is executed. Thus it manages the memory with regard to the sensor data. In particular the management subgroup can receive sensor data for the value document and store this in the memory, wherein memory addresses are set for the sensor data for the value document, and after establishment of a result, the area of the memory in which the sensor data for the value document were stored is again released or overwritten with sensor data for a following value document.

In general, the management subgroup, in the device upon execution of the management component, can control the internal operations in the evaluation device and communicate with other devices.

Thus it is preferred that by means of the management subgroup, signals of at least one other device are received and/or signals to at least one other device are sent and preferably in dependence on at least one result of the evaluation at least one signal is emitted by means of which the further processing of the value document is controllable. In the device it is then preferred the management component is devised such that upon execution by the management component by the management subgroup, signals of at least one other device are received and/or signals to at least one other device are sent and preferably in dependence on at least one result of the evaluation at least one signal is emitted by means of which the further processing of the value document is controllable. For the reception of the signals of the at least one other device, the device can have a suitable interface which can be utilized, where applicable, also by several other devices. In doing so, the interface can comprise hardware components and software components. The interface can also be designed for emitting the signals, it is, however, also possible to supply at least one other interface for the emission of the signals. The other devices can in particular have one, preferably at least two, sensors for capturing properties of the value document, which as signals emit sensor data, and/or have at least one device which generates signals which displays the availability of such sensor data and/or the occurrence of a pre-specified event, preferably with regard to the transport of the value document in a value-document processing apparatus in which the sensor or sensors are arranged. In particular in the case of a device having at least one sensor, the management subgroup, in the device upon execution of the management component, pre-specifies a memory area in the memory in which the sensor data are stored. In the case of at least two sensors it pre-specifies for the sensor data of each of the sensors respectively one memory area associated with the respective sensor in which the sensor data of the respective sensor are stored. Further the management subgroup, in the device upon the execution of the management component, again releases the memory areas after the end of the evaluation. As signals also interrupts can occur whose processing upon a running evaluation could otherwise be disrupting, in particular for the evaluation subgroup. Furthermore the end of the evaluation is monitored by the management subgroup, in the device upon execution of the management component by the management subgroup. For example, the monitoring can comprise monitoring whether a value for a pre-specified result of the evaluation was stored in the memory. In dependence on the result of the evaluation, the device can emit a signal by means of the management subgroup upon execution of the management component, which represents the result of the evaluation, for example a sorting class. In dependence on the sorting class, the value document can be further treated. The signal, which can also represent data, can be emitted, for example, to a machine control which controls a value-document processing apparatus or at least part of the same. This procedure has the advantage that the management component or management subgroup can process interrupts connected to the reception of sensor data, the evaluation component or subgroup thereof, however, remains untouched.

Further, evaluation information is generated and stored by the management subgroup, in the device upon execution of the management component, for received sensor data for a value document. The evaluation information is employed upon the carrying out of the evaluation. Preferably it can comprise information by means of which the at least one evaluation subgroup, in the device upon execution of the evaluation component, can access the sensor data for the value document, where applicable, for different sensors. The evaluation can in principle be carried out, controlled solely by the operating system, by the evaluation subgroup. However, the evaluation of the sensor data can frequently comprise at least two partial evaluations. In doing so, the carrying out of a partial evaluation can yield a result which is employed by a further partial evaluation. Further, partial evaluations can also be executed at least partially in parallel, in particular if the evaluation subgroup comprises more than one core. It is hence preferred in the method that the evaluation information contains information about partial evaluations which are partial portions of the evaluation of the sensor data which are to be carried out by means of the at least one evaluation subgroup, and that the at least one evaluation subgroup carries out the partial evaluations in dependence on the evaluation information and stores their results in the memory. In the device, the evaluation information then preferably contains information about partial evaluations, which are partial portions of the evaluation of the sensor data, which are to be carried out by the evaluation component upon execution by the at least one evaluation subgroup; further in the device the evaluation component preferably carries out the partial evaluations upon execution by the at least one evaluation subgroup in dependence on the evaluation information and stores their results in the memory. The result of the evaluation can comprise one of the results or some of the results of the partial evaluations. This design has the advantage that the evaluation can be controlled in knowledge of the dependence of the partial evaluations from each other such that the total time for the execution of the partial evaluations can be reduced. The evaluation information can for this purpose contain in particular also information from which is establishable where the result of a partial evaluation should be stored. According to one embodiment it is possible that a partial evaluation in which only the results of previously carried out partial evaluations are employed is executed by the management subgroup.

The results of the partial evaluations can in principle be stored arbitrarily in the memory. In the method it is, however, preferred that for a respective value document results of the partial evaluations are stored in the memory in a pre-specified data structure. The device can for this purpose preferably be further designed such that upon execution of the software for a respective value document results of the partial evaluations are stored in the memory in a pre-specified data structure. In the method, one of the partial evaluations, which requires a result of a previously ended partial evaluation of at least one part of the sensor data for the same value document, can then access the data structure to be able to simply read the result. The management of the data structure, in particular their supplying, can in the method be effected preferably by the management subgroup. In the device the management component can be designed such that upon execution by the management subgroup, the data structure is managed, preferably created. This yields a further relief of the at least one evaluation subgroup. In some embodiments the evaluation information can comprise information by means of which the data structure can be accessed from the evaluation component.

Particularly preferably, in the method the evaluation information can have at least one list of evaluation descriptors which describe partial evaluation, and the partial evaluations can be carried out on the basis of the list and the results stored in the memory. In the device, the management component can on that purpose preferably be devised such that the evaluation information has at least one list of evaluation descriptors which describe partial evaluations, and the evaluation component is devised to carry out the partial evaluations on the basis of the list and to store the results in the memory. Besides the information which states the respective partial evaluation, the evaluation descriptors can preferably contain information about sensor data stored in the memory, for example a pointer to the memory location, and/or results of other partial evaluations which are employed in the respective partial evaluation.

In the method it can hence be preferred that in at least one of the partial evaluations at least one result of a previously carried out partial evaluation is employed, said results preferably being stored in the memory. For this, in the device preferably at least one of the partial evaluations can employ at least one result of a previously carried out partial evaluation, said results preferably being stored in the memory.

The order of carrying out the partial evaluations can in principle be effected in different ways. To avoid, for example, a waiting of a partial evaluation for a result of another partial evaluation as far as possible or to reduce the waiting time, it is preferred in the method that priorities are assigned to the partial evaluations, and these are taken into consideration upon the execution of the partial evaluations. For this, in the device preferably priorities can be assigned to the partial evaluations and these can be taken into consideration upon the execution of the evaluation component or the partial evaluations. In this manner the results of pre-specified partial evaluations can be obtained particularly early, whether to employ them outside the device, or whether to employ them upon subsequent partial evaluations. Particularly preferably, the evaluation information for at least one of the partial evaluations can contain priority information which is taken into consideration upon the execution of the partial evaluations. By the allocation of the priorities, which is preferably also possible for processes of the management component, in the respective component the allocation of cores to tasks or processes can be controlled independently. The division of the cores into subgroups has in this connection the advantage that a modification of priorities in one component does not influence the second component and the effects of a priority change are easier to estimate.

According to the invention it is not necessary to have only one evaluation subgroup. Thus it can be preferred in the method that at least two evaluation subgroups are formed, preferably with the same number of cores, and by means of the management subgroup for each of the evaluation subgroups, evaluation information associated with the respective evaluation subgroup is stored in the memory, and each of the evaluation subgroups employs evaluation information associated with it. In the device for this purpose at least two evaluation subgroups can be formed, preferably having the same number of cores, and for each of the evaluation subgroups the management component can store evaluation information associated with the respective evaluation subgroup in the memory, and each of the evaluation subgroups upon execution of the evaluation component can employ the evaluation information associated with it and preferably store the results established in the evaluation in the memory. In doing so, the results are preferably stored such that these are associated with the evaluation subgroup, and/or preferably such that the results of the evaluations or partial evaluations of the evaluation subgroups or evaluation components are stored separately from each other or mutually distinguishable. In doing so, the evaluation subgroups are preferably managed by the same entity of the operating system and preferably execute different entities of the same evaluation component. In particular, in the method, by means of the management subgroup, sensor data sets for different value documents can be stored in the memory and for each of the sensor data sets, evaluation information be stored in the memory, and respectively one of the evaluation subgroups can, according to the evaluation information associated with the sensor data set, evaluate the sensor data of the sensor data set at least partially and store the results for the sensor data set in the memory. On that purpose, in the device, the management component can for this purpose preferably be devised to store sensor data sets for different value documents in the memory and to store evaluation information for each of the sensor data sets in the memory, so that the evaluation component upon execution by one of the evaluation subgroups according to the evaluation information associated with the evaluation subgroup and the sensor data set evaluates the sensor data of the sensor data set at least partially and stores the results for the sensor data set in the memory. If several value documents are examined successively, for which respectively a sensor data set with sensor data was captured, in this manner sensor data of a sensor data set for one of the value documents can be evaluated by the one of the evaluation subgroups and sensor data of another sensor data set for another of the value documents be evaluated by another of the evaluation subgroups. In many cases a time period is in this manner available for evaluating the sensor data for respectively one of the value documents which is longer than the temporal distance interval of consecutive value documents. In the case that the evaluation subgroups have respectively the same numbers of cores, a further advantage exists in the fact that for each of the value documents automatically respectively the same number of cores is available for evaluating. However, the evaluation is effected respectively by means of entities of the same evaluation component. The results of the evaluation or the partial evaluations are stored in the memory associated with the respective value document or the respective evaluation subgroup.

In a development of the invention it can be preferred in the device that the software comprises at least one auxiliary component, wherein the device is further designed such that at least one auxiliary subgroup of the cores is formed, and the at least one auxiliary component upon execution by the at least one auxiliary subgroup executes pre-specified operating-system tasks. In the method it is then preferred that an auxiliary subgroup of the cores is present, and the auxiliary subgroup carries out pre-specified operating-system tasks. The auxiliary subgroup can be formed analogously to the other subgroups and comprises at least one of the cores of the multi-core processor which is not a member of one of the other subgroups. The operating-system objects can preferably be tasks in connection with the reception or the sending of data, particularly preferably in connection with an IP stack, or the treatment of interrupts.

A further object of the present invention is a computer program for executing by means of a data processing device, having a multi-core processor which contains program code upon whose execution by the multi-core processor a method according to the invention is executed.

A further object of the present invention is a data carrier on which a computer program according to the invention is stored. The data carrier is constituted such that preferably the computer program is stored on it not only in volatile form.

BRIEF DESCRIPTION OF THE DRAWINGS

The invention will hereinafter be further explained by way of example with reference to the drawings. There are shown.

DETAILED DESCRIPTION OF VARIOUS EMBODIMENTS

Figure 1:
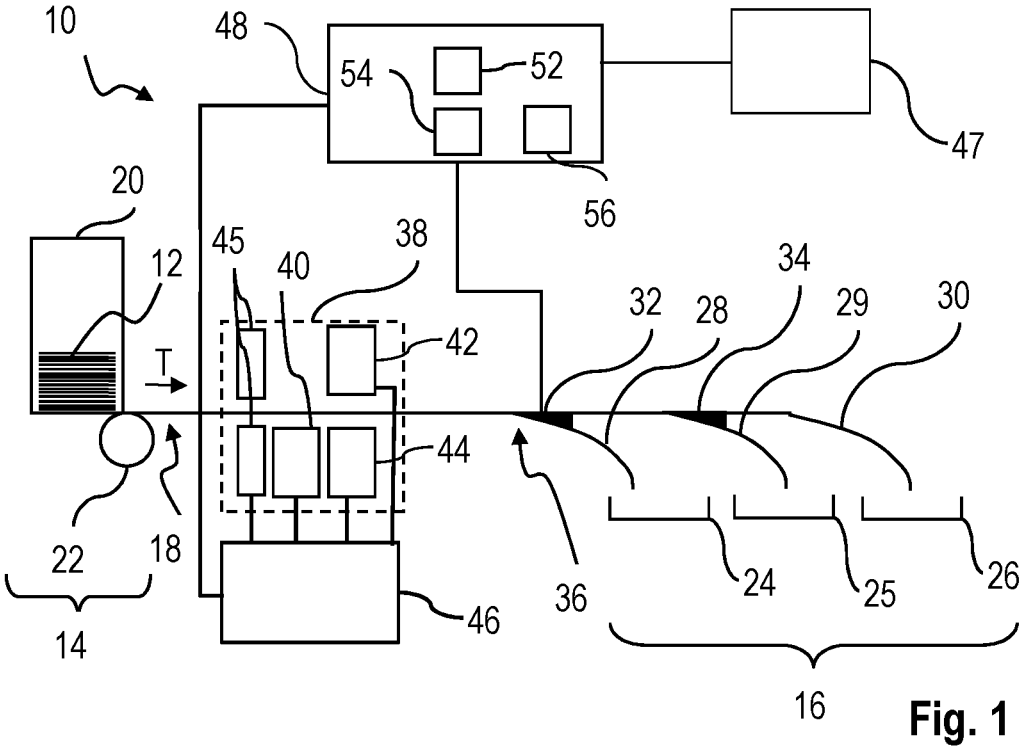
FIG. 1 a schematic view of a value-document processing apparatus in the form of a bank-note sorting apparatus, FIG. 2 a schematic block representation of an example of an evaluation device of the value-document processing apparatus in FIG. 1, FIG. 3 a schematic representation for illustrating the interaction of a management component and an evaluation component of the evaluation device in FIG. 2, FIG. 4 a very schematic flowchart of an example of a method for evaluating sensor data by means of the evaluation device in FIG. 2, FIG. 5 a very schematic flowchart of substeps of a step of the method in FIG. 4, FIG. 6 a schematic block representation of a second example of an evaluation device for evaluating sensor data which is employable in the apparatus in FIG. 1, FIG. 7 a schematic representation for illustrating the interaction of a management component and an evaluation component of the evaluation device in FIG. 6, and FIG. 8 a schematic block representation of a third example of an evaluation device for evaluating sensor data which is employable in the apparatus in FIG. 1.

A value-document processing apparatus 10 in FIG. 1, in this example an apparatus for processing value documents 12 in the form of bank notes, is designed for sorting value documents in dependence on the recognition of the authenticity and the state and, where applicable, the currency and denomination of processed value documents.

The apparatus 10 has in or on a housing (not shown) a feeding device 14 for feeding value documents, an output device 16 for receiving processed, i.e. sorted, value documents, and a transport device 18 for transporting singled value documents from the feeding device 14 to the output device 16.

The feeding device 14 comprises, in this example, an input pocket 20 for a value-document stack and a singler 22 for singling value documents out of the value-document stack in the input pocket 20 and for feeding the singled value documents to the transport device 18.

The output device 16 comprises, in this example, three output portions 24, 25 and 26 into which processed value documents, sorted according to the result of the processing, can be sorted. In the example each of the portions comprises a stack pocket and a stacking wheel (not shown) by means of which fed value documents can be deposited in the stack pocket.

The transport device 18 has at least two, in this example three, branches 28, 29 and 30 at whose ends respectively one of the output portions 24 or 25 or 26 is arranged, and has, at the branching points, gates 32 and 34, controllable by actuating signals, by means of which value documents are feedable to the branches 28 to 30 and thus to the output portions 24 to 26 in dependence on actuating signals.

On a transport path 36, defined by the transport device 18, between the feeding device 14, in this example more precisely the singler 22, and the first gate 32 after the singler 22 in the transport direction, a sensor device 38 is arranged which measures physical properties of value documents while the value documents are being transported past and forms sensor signals representing the measuring results. In this example, the sensor device 38 has three sensors, i.e. on mutually opposing sides of the transport path 36 respectively an optical remission sensor 40 or 42, which respectively captures a remission colored image and a remission IR image of the value document, and an optical transmission sensor 44, which captures a transmission colored image and a transmission IR image of the value document. Further a transmission ultrasonic sensor 45 is provided, which captures or measures ultrasound transmission properties of the value document in a spatially resolved manner. The sensor signals formed by the sensors correspond to sensor data or raw data of the sensors which, depending on the sensor, may have already been subjected to correction, for example in dependence on calibrating data and/or noise properties.

For evaluating the sensor data which were captured respectively for a value document by the sensors of the sensor device, the apparatus has an evaluation device 46 which is connected via data connections to the sensors 40, 42, 44 and 45.

For displaying operator control data and operating data, the value-document processing apparatus 10 has a display device 47, which is realized in this example by a touch-sensitive display device (touch screen). The display device 47 hence serves as an input/output device of the apparatus.

A control device 48 is connected via signal connections to the evaluation device 46, the input/output device 47 and the transport device 18, in particular to the gates 32 and 34. It controls, among other things, the transport device 18 in dependence on signals from the evaluation unit 46. For this purpose it has a processor 54 which is connected to the transport device for controlling said device and emits corresponding signals to it, as well as a memory 52 in which software is stored upon whose execution by the processor 54, among other things in dependence on signals of the evaluation device 46, actuating signals depending on the signals are emitted to the transport device 18. In a further memory device 56, processing data arising during the processing can be stored not only briefly, but for several value documents.

The value-document processing apparatus 10 is designed for sorting value documents in dependence on their state or quality and their authenticity and, where applicable, their currency and denomination. In particular, the evaluation device 46 and the control device 48 are accordingly designed for this purpose.

For sorting, value documents are singled out of the feeding device 14 and transported past the sensor assembly 38 or therethrough. The sensor assembly 38 captures or measures physical properties of the value documents respectively transported therepast or therethrough, and forms sensor signals or a stream of sensor data which describe the measurement values for the physical properties. In dependence on the sensor signals of the sensor device 38 for a value document and on classification parameters stored in the evaluation device, the evaluation device 46 classifies the value document as one of pre-specified authenticity classes and one of pre-specified state classes and emits a corresponding signal or corresponding data, which represents or represent the established classes, to the control device 48; by emitting actuating signals, the control device 48 in response to the signal or the data controls the transport device 18, here more precisely the gates 32 or 34, such that the value document is output in accordance with its class established upon the classification into an output portion of the output device 16 associated with the class. The association with one of the pre-specified authenticity classes or state classes or the classification is effected here in dependence on at least one pre-specified authenticity criterion or state criterion.

Figure 2:
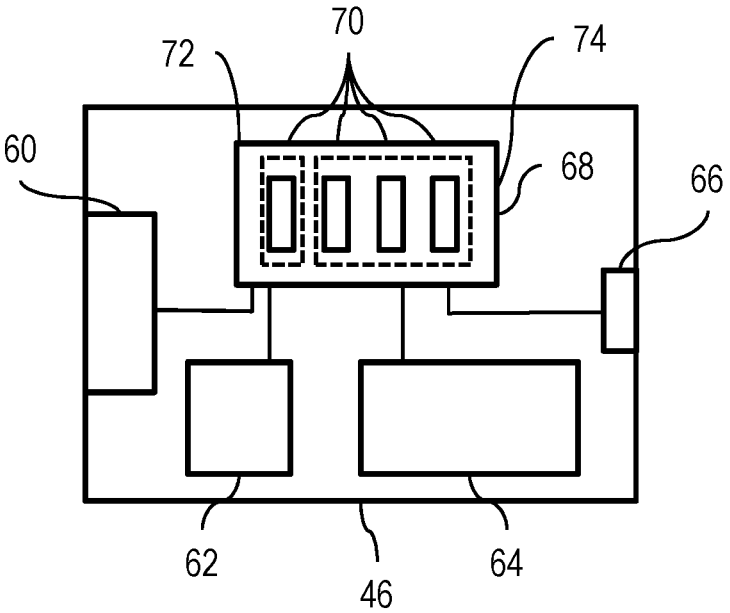

The evaluation device 46 is illustrated very schematically in FIG. 2.

It has a sensor interface device 60 for connecting to the sensors of the sensor device 38, a memory device 62 for storing software, a memory 64 for temporarily storing data arising upon the evaluation of sensor data and an interface device 66 via which the evaluation device 46 is connected to the control device 48, and a multi-core processor 68 which is connected to the stated components 60, 62, 64 and 66 via data connections.

The multi-core processor 68 has at least two cores, in the example four cores 70, which are of same designed and have access to the same memory 64. Furthermore, it can also have other components for operating the multi-core processor which are usually present but not shown.

In the memory 62, software is stored upon whose execution by the multi-core processor 68, among other things, the hereinafter described method is executed.

The software comprises in particular an operating system 71 (cf. FIG. 3), in the example a real-time operating system, a management component and an evaluation component. Further, configuration data which are employed by the operating system and/or the two other components are stored in the memory 62. Examples of suitable real-time operating systems are corresponding Linux derivatives, VxWorks or RTEMS.

During operation of the value-document processing apparatus 10, for a value document 10 upon its transport past the sensor device 38, sensor data are formed by each of the sensors 40, 42, 44 and 45 and are transferred to the evaluation device 46.

Upon switch-on of the evaluation device 46, the multi-core processor 68 executes the software stored in the memory 62, in particular a single entity of the operating system which manages the cores of the multi-core processor. In doing so, two subgroups of the cores are formed by the operating system 71, so that a core belongs to at most one subgroup. More precisely, one management subgroup 72 and in this embodiment example one evaluation subgroup 74 are formed. Corresponding configuration data are stored in the memory 62.

As in FIG. 2 illustrated, the management subgroup 72 comprises in the present embodiment example exactly one of the cores 70 and the one evaluation subgroup 74 the remaining three cores 70.

The subgroups 72 or 74 execute respectively an entity of a component associated with them: the management component is executed solely by the management subgroup 72 and a respective entity of the evaluation component, in this example only one, by the respective evaluation subgroup 74. The software is designed such that priority-controlled, pre-emptive multitasking is employed by the respective subgroup upon the execution of the associated component. The interaction of the components is illustrated very schematically in FIG. 3.

The operating system 71 further regulates the employment of the cores of the subgroups for the tasks to be processed independently for each of the subgroups.

The management component is executed by the management subgroup 72 which controls the internal operations within the evaluation device 46 and which communicates with the environment, in the example the control device 48 and signal sources (not shown) of the apparatus. Upon execution by the management subgroup 72, the management component yields a system of different processes which manage a plurality of events and whose operations have to be effected according to a pre-specified temporal scheme. For example, the incoming data of the sensors have to be treated. For the temporal control of the execution of the processes by the management subgroup, here more precisely its core, in other embodiment examples their cores, a corresponding scheduler is provided which in this example is implemented by the operating system.

The evaluation subgroup 74 executes upon execution of the evaluation component in dependence on the evaluation information the evaluation of the received sensor data and stores the results in the memory 64. The evaluation can be divided into several partial portions and accordingly partial evaluations.

Figure 3:
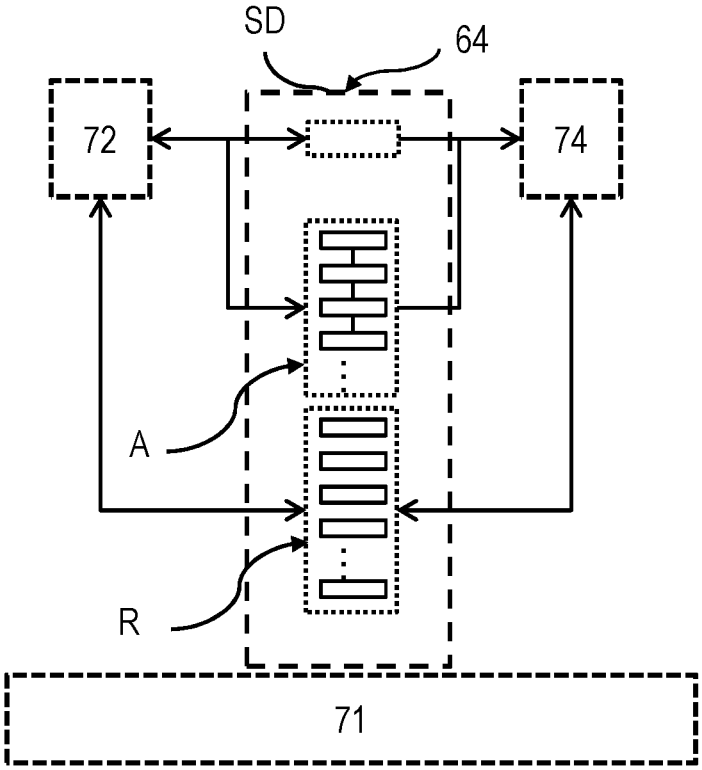

If at least two partial evaluations are provided by sensor data for a value document, these can be executed, where applicable, at least partially concurrently or in parallel. Further at least one of the partial evaluation can comprise, where applicable, the execution of at least two functions which can be executed likewise at least partially in parallel or concurrently. The software is designed such that for executing an entity of the evaluation component, several worker threads are made available which execute the partial evaluation or partial evaluations stated by evaluation descriptors of the evaluation list. Each of the worker threads executes a partial evaluation stated by the evaluation information. If the number of the partial evaluations is greater than the number of the worker threads, each of the threads first carries out one of the partial evaluations. Upon termination of the execution the worker thread then executes a partial evaluation given by the evaluation information whose processing was not yet begun by one of the other worker threads. The allocation of cores of the subgroup to worker threads is effected by means of a scheduler. This carries out the temporal control of the processing by the cores and the distribution among the cores. The scheduler is associated solely with this evaluation subgroup and with it independent of other subgroups or schedulers working therein. The interaction of management component and evaluation component or management subgroup and evaluation subgroup and memory 64 is illustrated in FIG. 3.

In principle in other embodiment examples at least one of the partial evaluations can also contain parts executable in parallel. These can then be executed by another scheduler in a controlled manner. This scheduler is then executed in the application area and then works at a different level than the scheduler at operating-system level for the subgroup or component.

The management subgroup 72 upon execution of the management component stores sensor data SD in the memory 64. As indicated by the double arrow, it can also delete this again later.

Further it writes evaluation information A to the memory 64. Furthermore the management subgroup 72 upon execution of the management component in this example in the memory 64 creates a data structure R for the evaluation results to which it has reading and writing access.

The evaluation subgroup 74 can upon execution of the evaluation component access the sensor data SD as well as the evaluation information A for reading and the contents of the data structure for reading and for writing; this in turn is indicated by arrows. Upon execution of the partial evaluations according to the evaluation information A by the evaluation component, the results of the partial evaluations are established, which are written by the evaluation subgroup upon execution of the evaluation component to the data structure R in the memory 64. Should a partial evaluation require a result of a previously ended partial evaluation, it can access the content of the data structure R accordingly.

After the last partial evaluation, the results of the evaluation lie in the memory 64 in the data structure R. The management subgroup is now upon execution of the management component able to emit corresponding signals, for example to the control device 48.

Figure 4:
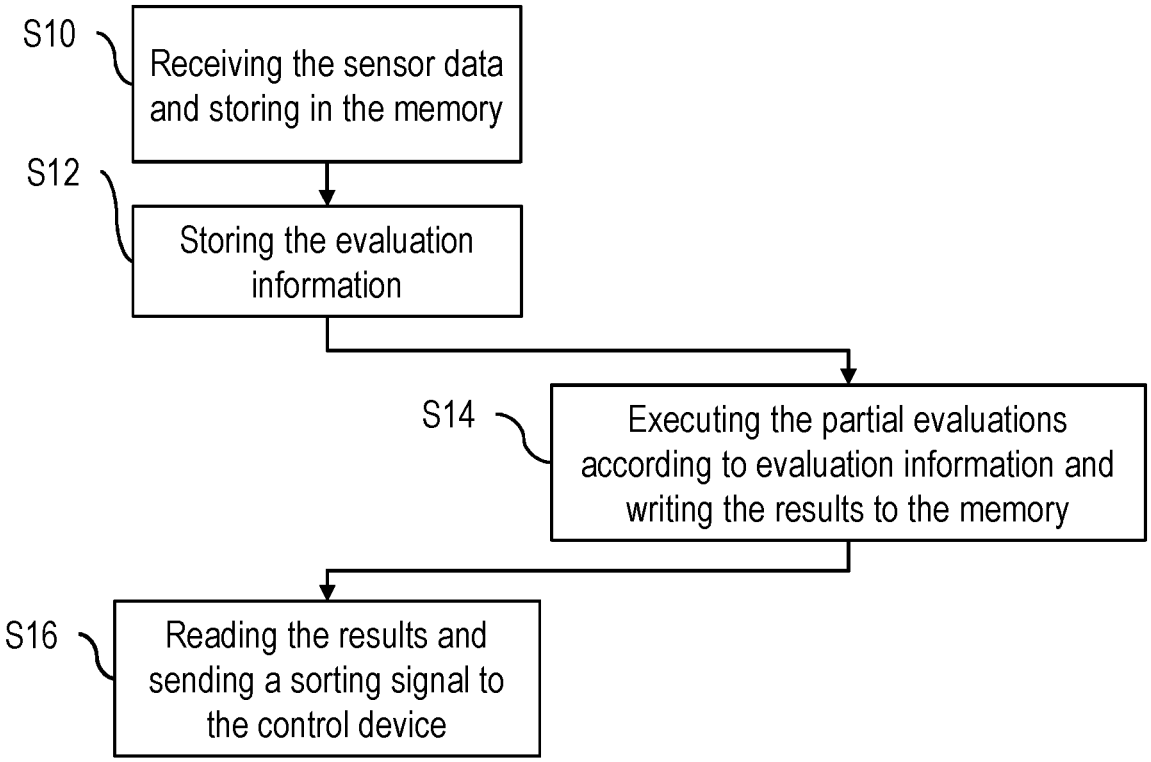

More precisely the following method is carried out for evaluating the sensor data for the value document. The procedure is illustrated in FIG. 4 as a flow diagram, wherein the steps listed in the left column are performed by the management subgroup upon execution of the management component and the steps listed in the right column by the evaluation subgroup upon execution of the evaluation component.

Upon reception of the sensor data for a current value document, the management subgroup in step S10 upon execution of the management component stores the sensor data in a corresponding data structure SD in areas of the memory 64 set by the management group. This happens such that an access to the sensor data of only one of the sensors by the evaluation subgroup 72 is possible upon execution of the evaluation component.

In step S12 the management subgroup upon execution of the management component generates and stores evaluation information A for evaluating the sensor data. In this example, the evaluation information comprises a list of evaluation descriptors. These comprise respectively a reference to the function to be executed respectively for the respective partial evaluation, to the sensor data to be used by the respective function and, if applicable, references to parameters used by the function which are to be used for the respective partial evaluation, for example specifications for areas of the value document to be examined or the like. Furthermore, the management subgroup supplies a data structure R for storing the results in the memory 64 of the partial evaluations still to be executed.

Figure 5:
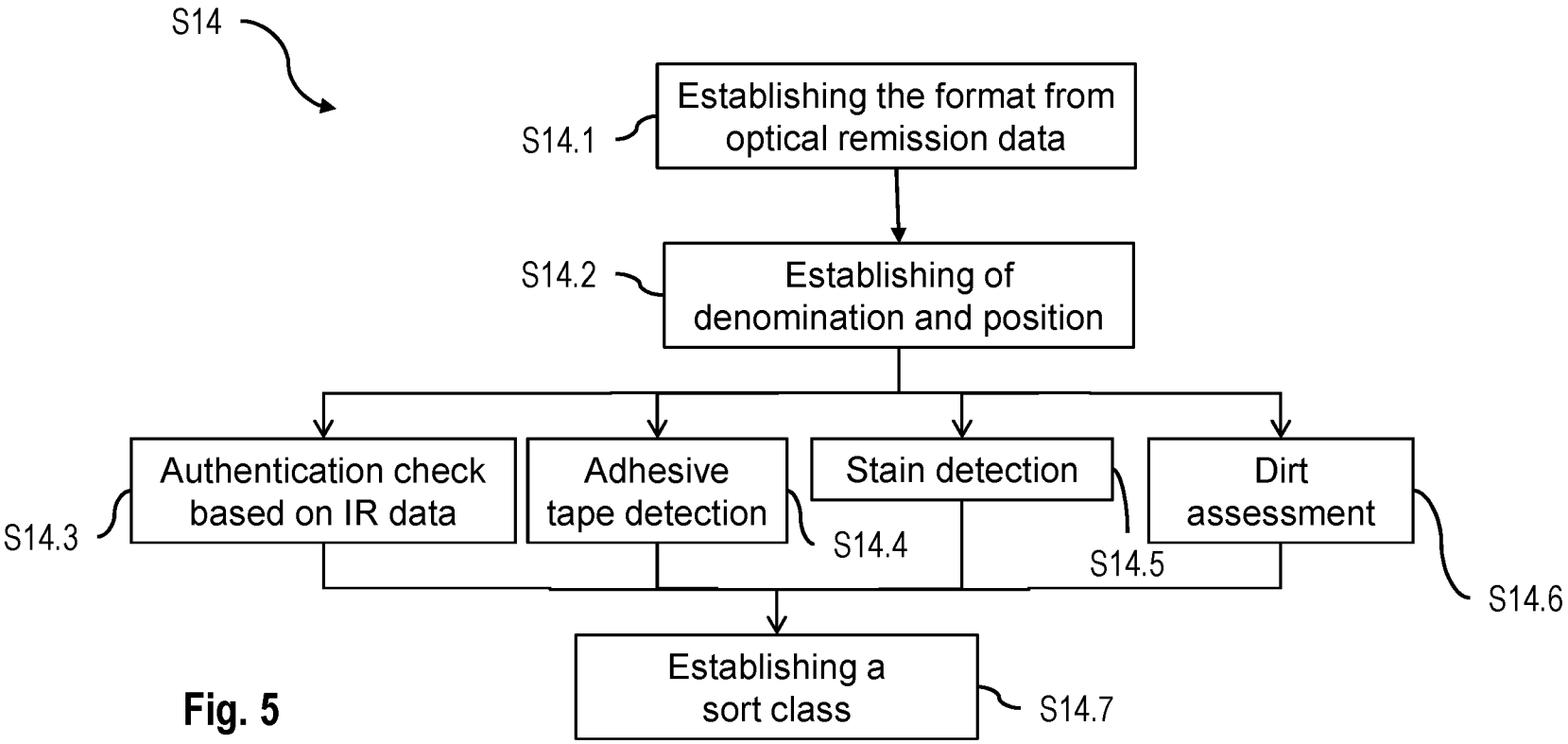

The evaluation subgroup 74 then carries out in step S14 the partial evaluations stated by the evaluation information. For this purpose the entries are employed in the list of the evaluation descriptors. For this purpose the software makes available, as explained above, a pre-specified number of worker threads which are executed at least partially in parallel by means of a scheduler of the evaluation subgroup or the evaluation component. Respectively an entry or a corresponding partial evaluation is executed by one of the worker threads, wherein the maximum number of active worker threads is pre-specified and their execution controlled by the scheduler. If a partial evaluation was ended, the worker thread executes a next partial evaluation which was contained in the list of the evaluation descriptors and was not yet begun or executed. The evaluation in step S14 is divided into partial evaluations as illustrated in FIG. 5.

First, in step S14.1 on the basis of the data of one of the optical remission sensors, which the evaluation descriptor refers to, upon a first partial evaluation a format of a value document is established, i.e. its length and width. Further a possible rotation vis-à-vis the transport direction is established. The results are stored in the corresponding data structure R in the memory 64.

In step S14.2, as the second partial evaluation a denomination and position or orientation of the value document are established. The position or orientation is to be understood as one of four possible orientations of the value document in a transport plane, which are obtainable by rotation around the longitudinal and/or transverse axis of the value document by 180°. For this purpose data of one of the optical remission sensors, which the corresponding evaluation descriptor refers to, and the result of the first partial evaluation are employed, which likewise refers to the corresponding evaluation descriptor. The partial evaluation waits, where applicable, until the results of the format recognition are available. While employing the result of the first partial evaluation, which the evaluation subgroup reads from the memory 64, and the sensor data of one of the optical remission sensors in the memory 64 according to the evaluation information, denomination and position are then established, wherein stored parameters are employed for the recognition of denomination and position. The result is in turn stored in the data structure in the memory 64.

The following partial evaluations S14.3 to S14.6 employ, among other things, the results of the second partial evaluation, thus of the recognition of denomination and position. Pointers to these results stored in the data structure in the memory 64 are establishable by means of information items in the respective evaluation descriptors. These partial evaluations can be executed at least partially in parallel by the cores.

The partial evaluation in step S14.3 contains an authenticity check on the basis of the optical IR sensor data and the result of the partial evaluation in step S14.2. The corresponding evaluation descriptor contains references to these data. The result is stored in the memory 64.

The partial evaluation in step S14.4 concerns the recognition of adhesive tape possibly present on the value document on the basis of the ultrasound-transmission data of the ultrasonic sensor 45 and the result of the partial evaluation in step S14.2. The corresponding evaluation descriptor contains references to these data. The result is stored in the memory 64 in the data structure provided for this purpose.

The partial evaluations in step S14.5 and S14.6 concern the recognition of stains on the value document and the recognition of dirt on the basis of the sensor data of the optical remission sensor and the result of the partial evaluation in step S14.2. The corresponding evaluation descriptor contains references to these data. The result is stored in the memory 64.

Upon the partial evaluation in step S14.7 the results of the previously completed partial evaluations of steps S14.1 to S14.6 from the data structure in the memory 64 are employed to determine a sorting class. In this simplified example the sorting class could be one of the classes "fit for circulation/authentic", "unfit for circulation/authentic", "fit for circulation/suspect" or "unfit for circulation/suspect". The result is stored in the memory 64, in this example in the corresponding data structure.

Upon execution of the management component, the management subgroup continually checks by monitoring the memory 64, more precisely the presence of the result of the step S14.6, whether a result is already present. If this is the case, it emits a sorting signal to the control device 46. Further, it releases the areas of the memory 64 in which the sensor data are stored, and deletes the results of the partial evaluations from the memory 64. In other embodiment examples a corresponding thread of the management component can be set to a wait state which is caused by the absence of the result. Upon presence of the result, the wait state is ended. This operation is executed by the operating system.

The method can then be continued with step S10 for a next value document.

In other embodiment examples, the evaluation information for at least one of the partial evaluations additionally comprises a specification by means of which an access is possible to a result obtained by a previous partial evaluation which is required by the function.

Figure 6:
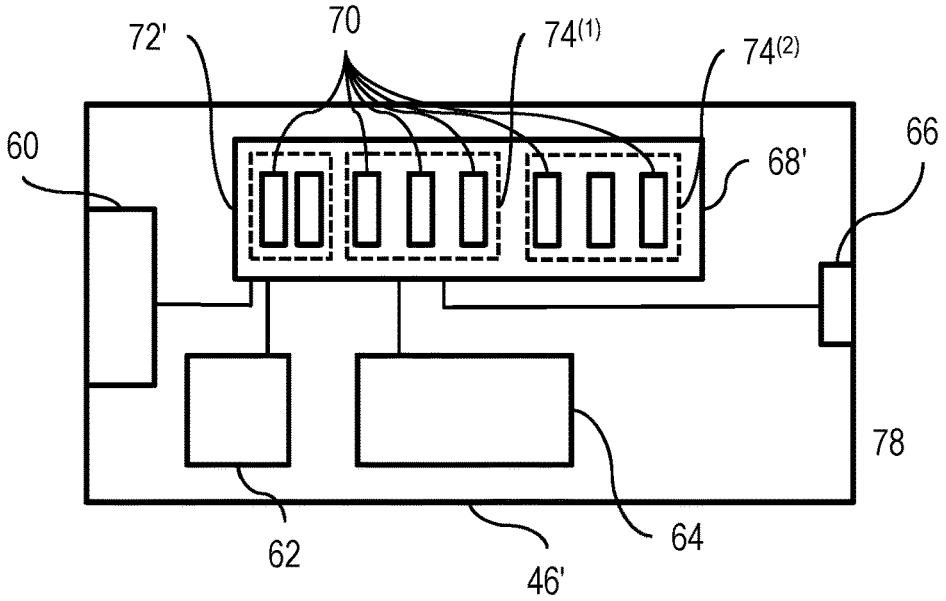
Figure 7:
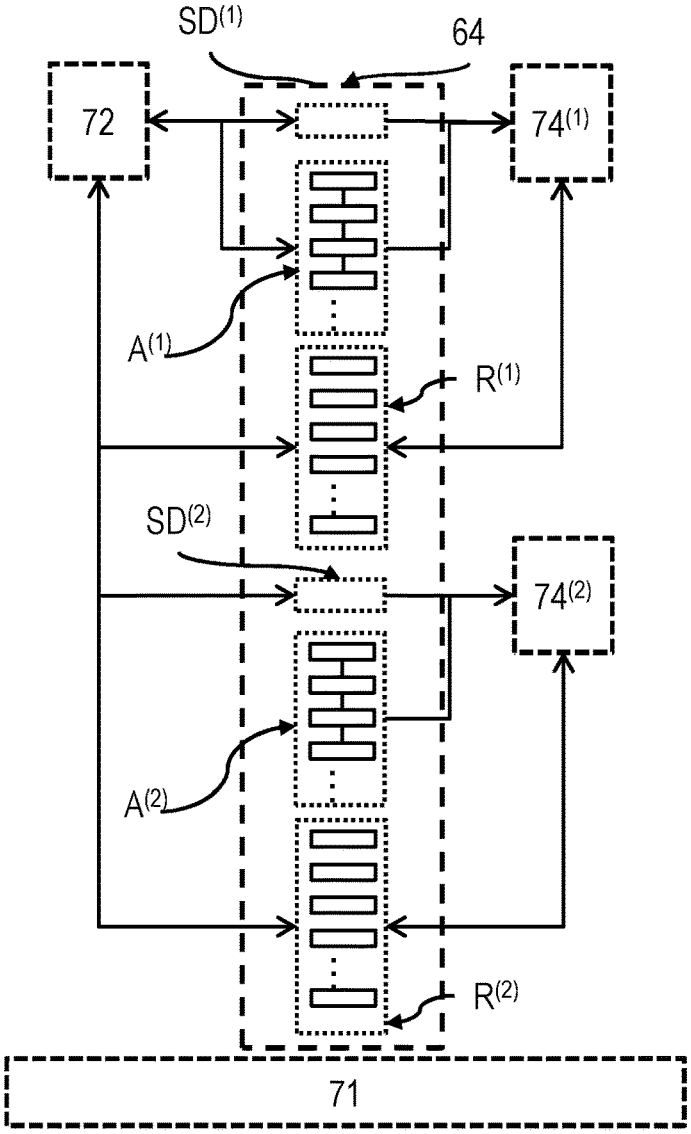

The second embodiment example in FIG. 6 and FIG. 7 differs from the first embodiment example by the fact that two evaluation subgroups are provided.

More precisely, the evaluation device 46' differs from the evaluation device 46 on the one hand by the fact that now a multi-core processor 68' with eight cores 70 is provided. Further the software is replaced in the memory 62 by the hereinafter described software. Otherwise the evaluation device does not differ from that of the first embodiment example.

The software is now changed such that a management subgroup 72' having two cores and two evaluation subgroups $\mathbf{74}^{(1)}$ and $\mathbf{74}^{(2)}$ having the same number of cores, here 3 cores, are formed. The evaluation subgroups execute different entities of the evaluation component independently of each other, wherein in each of the evaluation subgroups multitasking is employed independently of the respective other evaluation subgroup.

In the method, the evaluating of sensor data for the value document is already started when the evaluating of sensor data for a preceding value document is not yet completed. The evaluation of the sensor data of an earlier one of the value documents is carried out by a first one of the evaluation subgroups, the evaluation of the sensor data of a later one of the value documents in contrast is carried out by a second evaluation subgroup different from the first one. For this purpose these execute respectively own entities of the evaluation component.

As is illustrated in FIG. 7, the sensor data for consecutive value documents are now stored in separate memory areas $SD^{(1)}$ or $SD^{(2)}$ which are associated with the respective value document. The storing of the sensor data for the value document captured later is effected after the storing of the sensor data of the value document captured earlier; however, the storing can already begin when sensor data for the earlier value document are still present in the memory 64 and are at least partially processed.

Furthermore the management subgroup generates for the earlier and the later value document respectively separate evaluation information $A^{(1)}$ and $A^{(2)}$ which contain in particular information from which the position of the sensor data in the memory 64 is establishable for the respective value document. Further a data structure $R^{(1)}$ or $R^{(2)}$ is supplied for each of the value documents for storing the results of the respective partial evaluations. The evaluation information contains in particular also information by means of which it is establishable where results of partial evaluations are to be stored for the respective sensor data. In the example this could be respectively a pointer to the data structure to be employed.

Each of the evaluation subgroups is associated with one value document to the effect that it evaluates the sensor data for the value document, for which it employs the sensor data associated with the value document, the evaluation information associated with the value document and the data structure associated with the value document for storing the results. Because these evaluations are mutually independent, these can run respectively like in the first embodiment example. In particular, in each of the evaluation subgroups worker threads and a scheduler can be present independently of each other for controlling the execution of the worker threads which concern only the respective evaluation subgroup. Each of the evaluation subgroups hence works like in the first embodiment example, independent of the respectively other evaluation subgroup.

If upon execution of the management component the management subgroup recognizes that the evaluation is completed for the earlier one of the value documents, it forms a sorting signal corresponding to the result and emits this to the control device 48, so that this controls the apparatus accordingly, thus in the example in particular sets the gates for the value document. Further it releases the memory space for the sensor data, the evaluation information and the results for this value document.

A further, third embodiment example differs from the first embodiment example by the fact that a further subgroup of the cores, an auxiliary subgroup, is formed. A corresponding software component then upon execution by the auxiliary subgroup takes over the execution of certain operating-system operations, in the example operations in connection with the IP stack, in particular in connection with the data traffic from and/or to other devices which send data, for example sensor data, or only receive sensor data or results of the evaluations. The evaluation subgroup then has only two cores. If in other embodiment examples a multi-core processor with more than four cores is employed, the division can provide that the management subgroup and auxiliary subgroup have respectively one of the cores and the other cores are assigned to the evaluation subgroup or, in still other embodiment examples, the evaluation subgroups.

Figure 8:
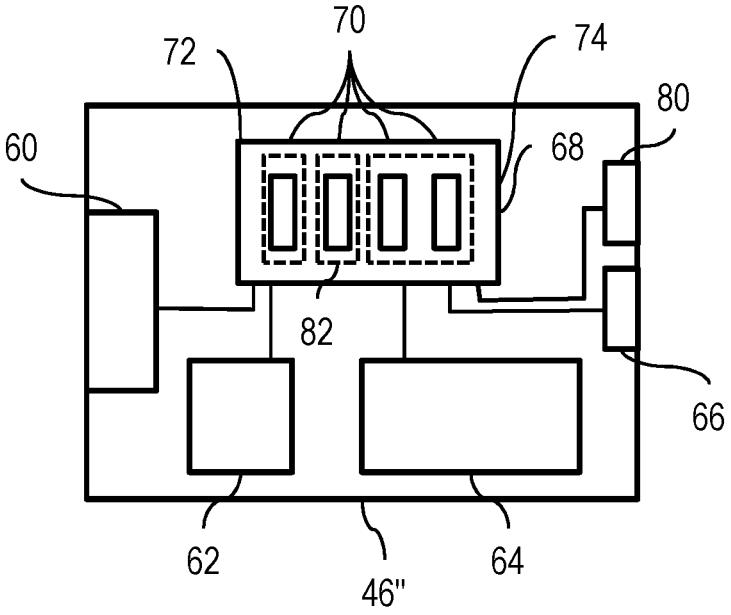

The evaluation devices 46", illustrated very schematically in FIG. 8, differs from the evaluation device 46 by a network interface 80 via which, triggered by the multi-core processor 68, data can be transferred to another device, for example for storing the data.

Except for a changed software, the evaluation device 46" does not differ from the evaluation device 46.

Besides the unchanged evaluation component and the unchanged operating system, the software comprises a changed management component and an auxiliary component.

By corresponding configuration by means of configuration data, three subgroups of the cores are formed upon starting the software in the operating system 71: as before a management subgroup 72, an evaluation subgroup 74 for executing the evaluation component, now, however, with only two cores, and an auxiliary subgroup 82 with a core 70 which executes the auxiliary component.

The auxiliary component comprises code upon whose execution by the auxiliary subgroup the stated operating-system functions are carried out, for example functions in connection with the IP stack upon the transfer of sensor data SD and evaluation results A from the memory 64 via the network interface 80. The management component is then nonessentially, or preferably not, loaded by these processes. Except for the functions which now the auxiliary component executes, the management component corresponds to the management component of the first embodiment example. This division has the advantage that the resource allocation can be designed more clearly or better structured as to processes or functions in the system containing many operations, which can then also lead to faster execution speeds.

In further embodiment examples the evaluation information for at least one of the partial evaluations can contain priority information. The allocation of cores to worker threads is then again effected via a scheduler, in particular scheduler of the operating system, in dependence on the priority information. This control can be effected independently in each of the evaluation subgroups.

In other embodiment examples configuration data can be employed upon forming the subgroups. The configuration data in the memory 62 then comprise data from which the number of cores of the management subgroup to be formed and the number of cores of the evaluation subgroup to be formed is establishable. The subgroups are then formed corresponding to these data.

The invention claimed is:

1. A device for evaluating sensor data for a value document, comprising:

a memory for storing at least the sensor data for the value document;

a multi-core processor having at least two cores; and software which comprises a management component and an evaluation component for carrying out evaluations of the sensor data;

wherein the device is devised such that a management subgroup of the cores is formed having at least one of the cores and at least one evaluation subgroup of the cores having at least one other of the cores, that the management component for its execution is associated with the management subgroup, and that the evaluation component for its execution is associated with the at least one evaluation subgroup, wherein upon execution by the management subgroup, the management component manages the memory with regard to the storing of at least the sensor data and generates evaluation information for carrying out the evaluation;

wherein upon execution by the at least one evaluation subgroup in dependence on the evaluation information, the evaluation component carries out at least one part of the evaluation and stores a result in the memory; and wherein each of the cores of the management subgroup and each of the cores of the at least one evaluation subgroup are managed by a same single operating-system entity.

2. The device according to claim 1, wherein both the cores of the management subgroup and the cores of the at least one evaluation subgroup have access to the memory.

3. The device according to claim 1, in which the management subgroup comprises exactly one core.

4. The device according to claim 1, in which the at least one evaluation subgroup comprises at least two cores.

5. The device according to claim 1, in which the management component is devised such that upon execution by the management component by the management subgroup, signals of at least one other device are received and/or signals to at least one other device are sent and preferably in dependence on at least one result of the evaluation at least one signal is emitted by means of which the further processing of the value document is controllable.

6. The device according to claim 1, in which the evaluation information contains information about partial evaluations, which are partial portions of the evaluation of the sensor data, which are to be carried out by the evaluation component upon execution by the at least one evaluation subgroup, and in which upon execution by the at least one evaluation subgroup in dependence on the evaluation information the evaluation component carries out the partial evaluations and stores the results of these in the memory.

7. The device according to claim 6, in which the management component is devised such that the evaluation information has at least one list of evaluation descriptors which describe partial evaluations, and the evaluation component is devised to carry out the partial evaluations on the basis of the list and to store the results in the memory.

8. The device according to claim 1, in which at least one of the partial evaluations employs at least one result of a previously carried out partial evaluation which is preferably stored in the memory.

9. The device according to claim 1, which is further designed such that upon execution of the software in the memory, a data structure is supplied in which for a respective value document results of the partial evaluations are stored.

10. The device according to claim 1, in which priorities are assigned to the partial evaluations and these are taken into consideration upon the execution of the evaluation component.

11. The device according to claim 1, in which at least two evaluation subgroups are formed, preferably with the same number of cores, and for each of the evaluation subgroups the management component stores evaluation information associated with the respective evaluation subgroup in the memory, and each of the evaluation subgroups upon execution of the evaluation component employs the evaluation information associated with it.

12. The device according to claim 1, in which the management component is devised to store sensor data sets for different value documents in the memory and to store evaluation information for each of the sensor data sets in the memory, so that the evaluation component upon execution by one of the evaluation subgroups according to the evaluation information associated with the evaluation subgroup and the sensor data set evaluates the sensor data of the sensor data set at least partially and stores the results for the sensor data set in the memory.

13. The device according to claim 1, in which the software comprises at least one auxiliary component, wherein the device is further designed such that an auxiliary subgroup of the cores is formed, and the auxiliary component upon execution by the auxiliary subgroup executes pre-specified operating-system tasks.

14. An apparatus for processing value documents, having a feeding device for feeding singled value documents, an output device for outputting processed value documents, a transport device for transporting singled value documents of the feeding device to the output device, a sensor device for capturing physical properties of the transport device of transported value documents and forming sensor data for the respective value document, and an evaluation device connected to the sensor device for evaluating the sensor data of the sensor device according to claim 1.

15. The apparatus according to claim 14, which further has a machine control device connected to the evaluation device which drives the transport device in dependence on the result of the evaluation of the sensor data.

16. The device according to claim 1, wherein the evaluation information includes evaluation descriptors describing functions to be executed in the evaluation of the sensor data.

17. A method for evaluating sensor data for a value document, comprising:

employing a memory and a multi-core processor which can access the memory, the multi-core processor including a plurality of cores, wherein a management subgroup of the cores comprises at least one of the cores and at least one evaluation subgroup of the cores comprises at least one other of the cores, managing by the management subgroup the memory with regard to storing of at least the sensor data and generating by the management subgroup evaluation information for carrying out the evaluation, and carrying out by the at least one evaluation subgroup, in dependence on the evaluation information at least one part of the evaluation and storing a result in the memory, wherein each of the cores of the management subgroup and each of the cores of the at least one evaluation subgroup are managed by a same single operating-system entity.

18. The method according to claim 17, wherein the management subgroup comprises exactly one core.

19. The method according to claim 17, in which the at least one evaluation subgroup comprises at least two cores.

20. The method according to claim 17, in which by means of the management subgroup, signals of at least one other device are received and/or signals to at least one other device are sent and preferably in dependence on at least one result of the evaluation at least one signal is emitted by means of which the further processing of the value document is controllable.

21. The method according to claim 17, in which the evaluation information contains information about partial evaluations which are partial portions of the evaluation of the sensor data which are to be carried out by means of the at least one evaluation subgroup, and in which the at least one evaluation subgroup carries out the partial evaluations in dependence on the evaluation information stores their results in the memory.

22. The method according to claim 17, in which the evaluation information has at least one list of evaluation descriptors which describe partial evaluation, and on the basis of the list the partial evaluations are carried out and the results are stored in the memory.

23. The method according to claim 17, in which in at least one of the partial evaluations at least one result of a previously carried out partial evaluation is employed, said results preferably being stored in the memory.

24. The method according to claim 17, in which in the memory a data structure is supplied in which for a respective value document results of the partial evaluations are stored.

25. The method according to claim 17, in which priorities are assigned to the partial evaluations, and these are taken into consideration upon the execution of the partial evaluations.

26. The method according to claim 17, in which at least two evaluation subgroups are formed, preferably having the same number of cores, and by means of the management subgroup, for each of the evaluation subgroups evaluation information associated with the respective evaluation subgroup is stored in the memory, and each of the evaluation subgroups employs evaluation information associated with it.

27. The method according to claim 17, in which by means of the management subgroup sensor data sets for different value documents are stored in the memory and for each of the sensor data sets evaluation information is stored in the memory, and respectively one of the evaluation subgroups evaluates the sensor data of the sensor data set according to the evaluation information associated with the sensor data set at least partially and stores the results for the sensor data set in the memory.

28. The method according to claim 17, in which an auxiliary subgroup of the cores is present, and the auxiliary subgroup carries out pre-specified operating-system tasks.

29. The method according to claim 17, wherein both the cores of the management subgroup and the cores of the at least one evaluation subgroup have access to the memory.

30. One or more non-transitory computer-readable media having stored thereon executable instructions that when executed by a data processing device for evaluating sensor data for a value document, the device including a memory and a multi-core processor with a plurality of cores wherein a management subgroup of the cores comprises at least one of the cores and at least one evaluation subgroup of the cores comprises at least one other of the cores, configure the device to perform at least the following employ a memory and a multi-core processor which can access the memory, the multi-core processor including a plurality of cores, wherein a management subgroup of the cores comprises at least one of the cores and at least one evaluation subgroup of the cores comprises at least one other of the cores, manage by the management subgroup the memory with regard to storing of at least the sensor data and generating by the management subgroup evaluation information for carrying out the evaluation, and carry out by the at least one evaluation subgroup, in dependence on the evaluation information, at least one part of the evaluation and storing a result in the memory, wherein same the cores of the management subgroup and same the cores of the at least one evaluation subgroup are managed by a same single operating-system entity.

* * * * *